US010791883B2

(12) United States Patent
Kepner

(10) Patent No.: US 10,791,883 B2
(45) Date of Patent: Oct. 6, 2020

(54) TOILET PAPER DISPENSING DEVICE, AND REPLENISHMENT METHOD THEREOF

(71) Applicant: Cole Davis Kepner, Barrington, RI (US)

(72) Inventor: Cole Davis Kepner, Barrington, RI (US)

( * ) Notice: Subject to any disclaimer, the term of this patent is extended or adjusted under 35 U.S.C. 154(b) by 0 days.

(21) Appl. No.: 16/213,511

(22) Filed: Dec. 7, 2018

(65) Prior Publication Data

US 2019/0191938 A1 Jun. 27, 2019

Related U.S. Application Data

(60) Provisional application No. 62/608,610, filed on Dec. 21, 2017.

(51) Int. Cl.
*A47K 10/38* (2006.01)
*A47K 10/32* (2006.01)

(52) U.S. Cl.
CPC ..... *A47K 10/32* (2013.01); *A47K 10/3836* (2013.01); *A47K 2010/326* (2013.01); *A47K 2010/3253* (2013.01)

(58) Field of Classification Search
CPC .... A47K 10/32; A47K 10/38; A47K 10/3836; A47K 2010/3253; A47K 2010/326
See application file for complete search history.

(56) References Cited

U.S. PATENT DOCUMENTS 2,908,450 A * 10/1959 Stone ..... A47K 10/3836 242/560
3,010,670 A * 11/1961 Jones ..... A47K 10/38 242/560
3,184,176 A * 5/1965 Tucker ..... A47K 10/38 242/560
3,346,208 A * 10/1967 Hoffman ..... A47K 10/3836 242/597.3
3,484,052 A * 12/1969 Clarke ..... A47K 10/3836 242/560.2
3,584,802 A * 6/1971 Sieber ..... A47K 10/38 242/560.2
3,586,252 A * 6/1971 Sutton ..... A47K 10/38 242/560.2

(Continued)

*Primary Examiner* — Michael E Gallion
(74) *Attorney, Agent, or Firm* — Burns & Levinson, LLP; George N. Chaclas

(57) ABSTRACT

A toilet paper dispenser has a toilet roll container defining a chamber sufficient to enclose a first toilet paper roll and a second toilet paper roll positioning the first and second paper rolls in an end to end orientation. The container has a longitudinal opening to allow dispensing of toilet paper sheets from the toilet paper rolls. A central divider within the container divides the container into two spaces for accommodating two toilet paper rolls. Each space containing toilet paper rolls includes a positioning insert centered on and located on opposite sides of the central divider that extend within the length of the container. The positioning inserts stabilize the toilet paper rolls within the container. A retaining member at each end of the container secures the toilet paper rolls within the container. A support fixes the container to a wall structure may allow rotation of the container around the center point of the container's longitudinal axis.

20 Claims, 5 Drawing Sheets

(56) References Cited

U.S. PATENT DOCUMENTS

| | | | | | |
|---|---|---|---|---|---|
| 4,615,442 | A * | 10/1986 | Beeken | A47K 10/3836 | 206/389 |
| 5,031,852 | A * | 7/1991 | Dowling | G03B 17/30 | 242/348.3 |
| 5,490,625 | A * | 2/1996 | Myatt | A47K 10/3827 | 225/47 |
| 5,868,342 | A * | 2/1999 | Moody | A47K 10/38 | 242/560 |
| 6,036,134 | A * | 3/2000 | Moody | A47K 10/3836 | 242/422.4 |
| 6,202,956 | B1 * | 3/2001 | Grasso | A47K 10/3836 | 242/560 |
| 6,488,229 | B2 * | 12/2002 | Denton | A47K 10/38 | 242/560.2 |
| 7,861,964 | B2 * | 1/2011 | Cittadino | A47K 10/3836 | 242/597.5 |
| 9,456,718 | B1 * | 10/2016 | Myatt | A47K 10/3827 | |
| 9,918,598 | B2 * | 3/2018 | Osborne | A47K 10/38 | |
| 2004/0004153 | A1 * | 1/2004 | Kapiloff | A47K 10/3836 | 242/597.8 |
| 2007/0290094 | A1 * | 12/2007 | Anderson | A47K 10/3836 | 242/594 |
| 2008/0156926 | A1 * | 7/2008 | Cattacin | A47K 10/3836 | 242/560 |
| 2011/0139920 | A1 * | 6/2011 | Formon | A47K 10/3836 | 242/559.2 |
| 2012/0248136 | A1 * | 10/2012 | Meyers | A61L 2/22 | 221/96 |
| 2015/0076277 | A1 * | 3/2015 | Elliott | A47K 10/3836 | 242/560 |

* cited by examiner

TOILET PAPER DISPENSING DEVICE, AND REPLENISHMENT METHOD THEREOF

CROSS-REFERENCE TO RELATED APPLICATION

This application claims the benefit of U.S. Provisional Application Ser. No. 62/608,610, filed Dec. 15, 2017, entitled Toilet Paper Dispenser.

The present disclosure relates generally to commercial toilet paper dispensing devices.

BACKGROUND

Toilet paper dispensers are commonly known to have various functional components. For example, simple household toilet paper dispensers may include a rotating single dowel supported between two support members. This is appropriate for household use as the toilet paper rolls are generally isolated from water spray and replacement rolls are readily available for replacing depleted toilet paper rolls.

In commercial use, toilet paper dispensers are subject to additional demands from household use. In a public restroom, the toilet paper dispenser is used by non-related users. As such, durability of the dispenser becomes increasingly important, such as for non-interrupted use, protection of the toilet paper from water damage and reduced maintenance requirements.

Business reputations may be damaged when restroom facilities provided by that business are substandard, and greater demands in the maintenance of the toilet paper dispenser directly affects a business' ability to provide optimal restroom facilities for its customers and employees.

There is a need in the field of toilet paper dispensers to provide a durable, user friendly, versatile and easy to maintain toilet paper dispenser system for commercial enterprises. The toilet paper dispenser invention described herein addresses these and other needs.

SUMMARY OF THE PRESENT INVENTION

The invention includes a toilet paper dispenser having a toilet roll container, that is preferably cylindrical, to enclose two toilet paper rolls in an end to end orientation with two openings along the longitudinal axis of the container. The openings extend from opposite ends of the container. A central divider in the container divides the container into two spaces and two positioning inserts are used to fix the toilet paper rolls within the spaces. Retaining members secure the toilet paper rolls in the container, and are removable using a screw mechanism along the edge of the container. A support for fixing the container to a wall structure is included.

The present invention also includes a toilet paper dispenser having a toilet roll container defining a chamber sufficient to enclose a first toilet paper roll and a second toilet paper roll positioning the first and second paper rolls in an end to end orientation, the container further including one or more openings along the longitudinal axis of the container to dispense sheets of toilet paper from the first and second toilet paper rolls when the first and second toilet paper rolls are present, a central divider within the container dividing the container in a first and second space for accommodating the first and second toilet paper rolls, respectively, wherein the central divider separates the first and second toilet paper rolls when the first and second toilet paper rolls are present inside of the container, a first and second positioning insert extending within the length of the container sufficient to stabilize the first and second toilet paper rolls within the first and second space when the first and second toilet paper rolls are present inside of the container, a first and second retaining member for securing the first and second toilet paper rolls within the container located on opposite ends of the container to secure the first and second toilet paper rolls within the container when the first and second toilet paper rolls are present inside of the container and a support for fixing the container to a wall structure. Preferably the support includes a mechanism adapted to rotate the container around the center point of the longitudinal axis and lock the container in its rotated position.

A method for replenishing a toilet paper dispenser is disclosed.

DETAILED DESCRIPTION OF THE PREFERRED EMBODIMENT

The invention includes a durable, user friendly, versatile and easy to maintain toilet paper dispenser system for commercial use.

Figure 1:
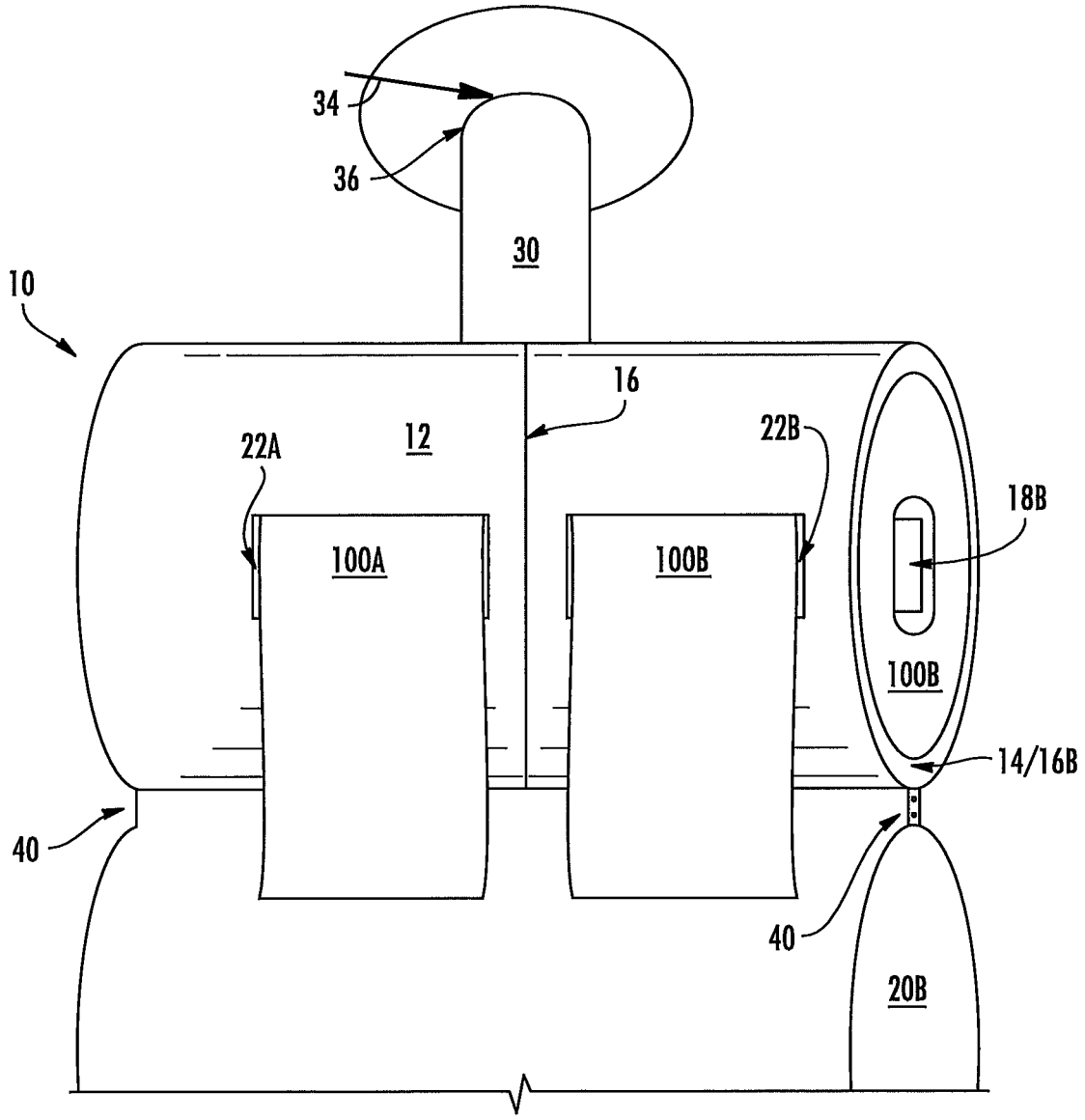
FIG. 1 is an angled front view of the toilet paper dispenser of the invention.
Figure 2:
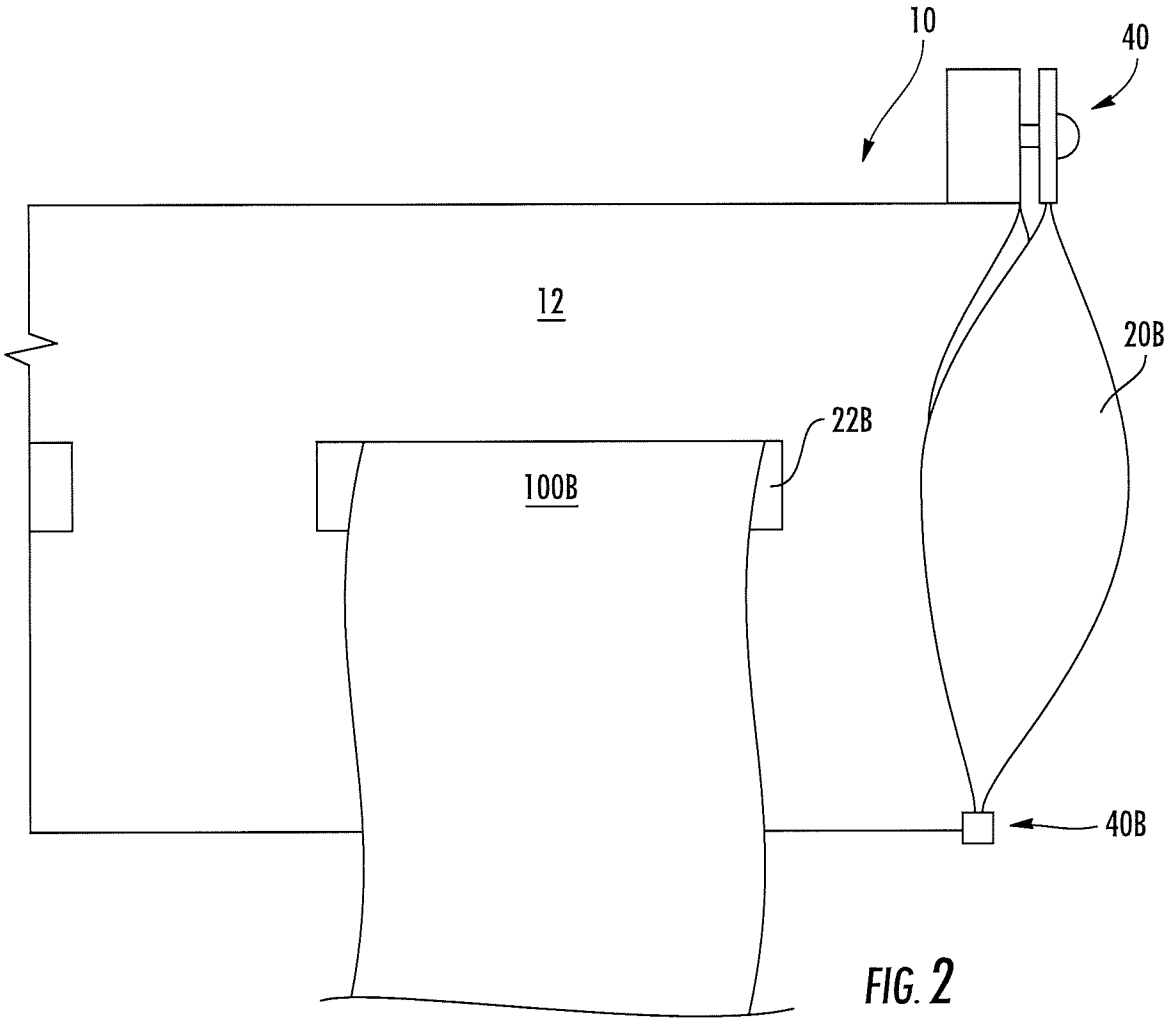
FIG. 2 is a partial front view of one side of the toilet paper dispenser of the invention.

Referring to FIGS. 1 and 2, the toilet paper dispenser 10 of the invention includes a toilet roll container 12 with the container 12 defining a chamber 14 sufficient to enclose a first 100A toilet paper roll and a second toilet paper roll 100B while positioning the first 100A and second 100B paper rolls in an end to end orientation. The container 12 further includes one or more openings 22A, 22B along the longitudinal axis of the container 12 to dispense of sheets of toilet paper from the first 100A and second 100B toilet paper rolls when the first 100A and second 100B toilet paper rolls are present within the container 12. The container 12 preferably has a solid structure that totally encompasses the first 100A and second 100B toilet paper rolls which generally limits physical contact with the first 100A and second 100B toilet paper rolls with the exception of physical access to the first 100A and second 100B toilet paper rolls through the openings 22A, 22B of the container 12. This containment of the first and second 100A, 100B toilet paper rolls protects the first and second 100A, 100B toilet paper rolls from water spray or other destructive events. Various constructions of the container 12 can be used such as, for example without limitation, transparent and obscured or visually blocked, or combinations thereof, with transparent most preferred. Composition of the container 12 can include plastics, metals, composites and the like useful in humid environments found in restrooms. The shape of the container 12 can be rectangular, cylindrical or other configuration that allows rotational movement of the first and second 100A, 100B toilet paper rolls. In a preferred embodiment the container 12 has a cylinder configuration of sufficient size to encompass standard sized toilet paper rolls allowing for unimpeded rotation of the first 100A and second 100B toilet paper rolls while minimizing any excess size or volume for this function. The openings 22A, 22B are preferably of sufficient size as to allow access to the toilet paper rolls 100A, 100B with an individual's fingers.

A central divider 16 within the container 12, when present, divides the container 12 in a first 16A and second 16B space for accommodating the first and second toilet paper rolls 100A, 100B, respectively. The central divider 16 separates the first 100A and second 100B toilet paper rolls when the first and second toilet paper rolls 100A, 100B are present inside of the container 12. The central divider 16 may include any suitable partisan for separating the first 100A and second 100B toilet paper rolls from frictional contact from each other while providing minimal frictional contact with either the first 100A or second 100B toilet paper rolls while the dispenser 10 is in use. In one preferred embodiment the central divider 16 has a solid, non-open structure providing smooth surfaces that are in contact with the first 100A and second 100B toilet paper rolls.

A first 18A and second 18B positioning inserts are positioned on opposite sides of the central divider 16 and are centered on the central divider 16 to accommodate the first and second toilet paper rolls 100A, 100B. The first 18A and second 18B inserts extend along the longitudinal length of the container 12 within the chamber 14 of the container 12. The length of the inserts 18A, 18B are sufficiently long to stabilize the first and second toilet paper rolls 100A, 100B within the first and second space 16A, 16B when the first and second toilet paper rolls 100A, 100B are present inside of the container 12. The first and second positioning inserts 18A, 18B can be either rotating or non-rotating, and configured to limiting any interference with rotation of the first and second toilet paper rolls 100A, 100B in either configuration. For example, rotating first and second positioning inserts 18A, 18B can include a frictional engagement mechanism with the first and second toilet paper rolls 100A, 100B, such as physical contact with the interior surface of the paperboard core thereof, to advance rotation. In non-rotating configurations the first and second toilet paper rolls 100A, 100B are positioned on positioning inserts 18A, 18B preferably having smooth surfaces to permit frictionless interaction of the positioning inserts 18A, 18B with the interior surface of the paperboard core of the first and second toilet paper rolls 100A, 100B. The first and second positioning inserts 18A, 18B are fixed within the chamber 14 to properly position the first and second toilet paper rolls 100A, 100B to ensure limited or no contact with the inner surfaces of the container 12. In one preferred embodiment the first or second positioning inserts 18A, 18B are affixed to the central divider 16. In a second preferred embodiment the first or second positioning inserts 18A, 18B are affixed to a first 20A and second 20B retaining member, respectively, of the container 12.

Figure 3:
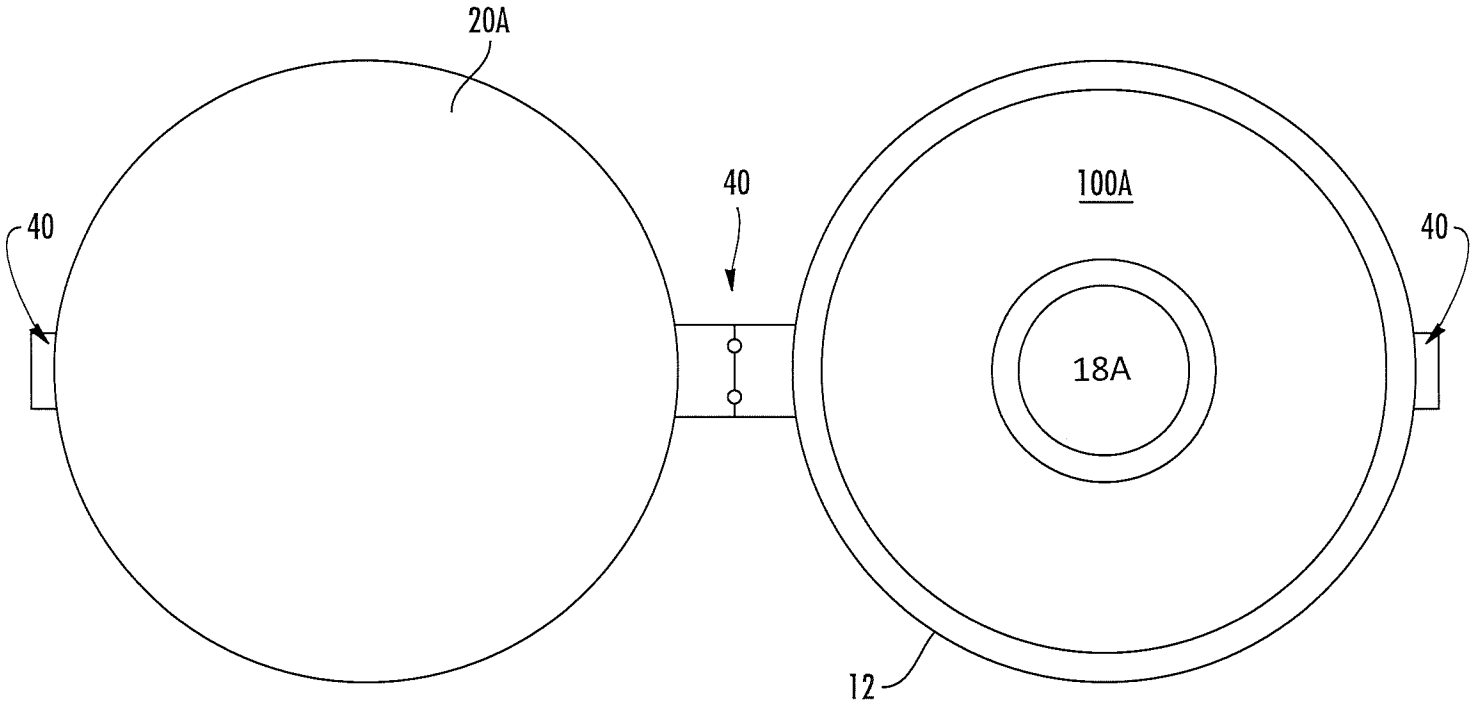
FIG. 3 is an end view illustration of a representative rotational member of toilet paper dispenser of the invention.
Figure 4:
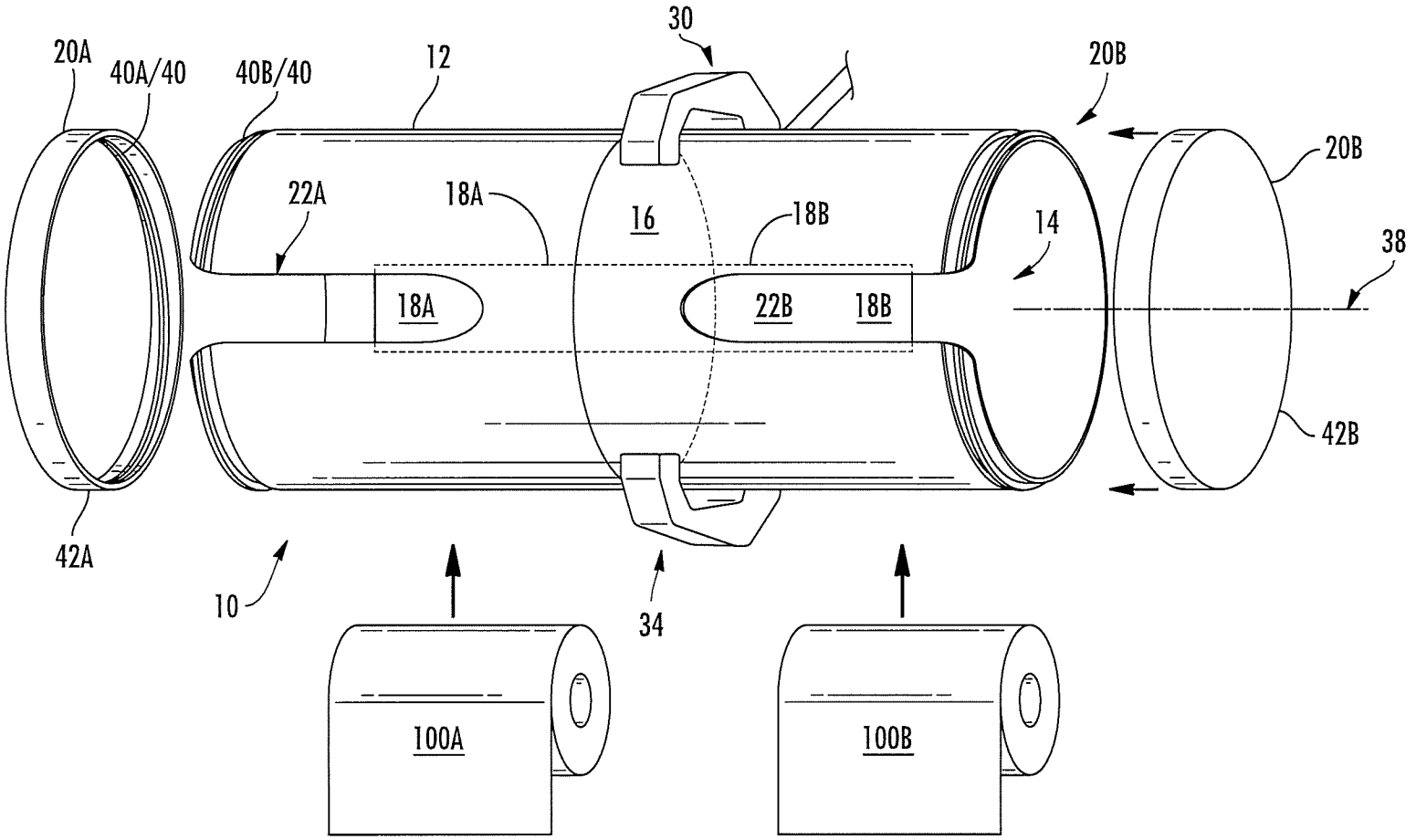
FIG. 4 is a front view of a preferred embodiment of the toilet paper dispenser of the invention.

The first 20A and second 20B retaining member are used for securing the first 100A and second 100B toilet paper rolls within the container 12 while the first 100A and second 100B toilet paper rolls are inserted over the positioning inserts 18A, 18B. The first 20A and second 20B retaining members are located on opposite ends of the container 12 to secure the first and second toilet paper rolls 100A, 100B within the container 12 when the first and second toilet paper rolls 100A, 100B are present inside of the container 12. The first and second retaining members 20A, 20B are attached to the container 12 to enclose and protect the first and second toilet paper rolls 100A, 100B inside of the container 12. The first and second retaining members 20A, 20B are attached to the container 12 using an attaching mechanism 40. The attaching mechanism 40 includes devices and/or method for securing the first and second retaining members 20A, 20B to the container 12 while allowing for proper use of the dispenser 10. Such attaching mechanisms 40 include, for example without limitation, threading (shown in FIG. 4), hinge (shown in FIG. 3), latches, snaps, keys, spring release, screws (shown in FIG. 2), and other like removable or displaceable connection pieces for allowing access into the container 12 for inserting and removing the first and second toilet paper rolls 100A, 100B, and additionally permitting the dispensing of sheets of toilet paper from the first and second toilet paper rolls 100A, 100B through the openings 22A, 22B.

Referring again to FIGS. 1 and 2, the dispenser 10 further includes a support 30 for fixing the container 12 to a wall structure 50. Generally the support 30 includes a rotator 36 adapted to rotate the container 12 around the center point 34 of the longitudinal axis 38 of the container 12 and lock the container 12 in its rotated position. The rotator 36 allows movement of the container 12 through rotation of the support 30, rotation of either end of support 30, or other like mechanical rotational components as understood by one of ordinary skill in the art for the purpose of such rotational movement. Preferably rotation of the container 12 includes locking or set stable positions of the container 12 in discrete positions as desired. Orientation of the container 12 may vary for customer use or resupply as appropriate for selected use. The support 30 is preferably fixed to the longitudinal center of the container 12. The support 30 and rotator 36 permit rotational movement sufficient to conveniently access a given toilet paper roll 100A, 100B and/or replace toilet paper rolls within the container 12. In a preferred embodiment the support and rotator 36 operate to engage a locking mechanism 32, preferably locking the container 12 after approximately a 45°, 60°, 90° or 180° rotation about a longitudinal axis of the container 12. The support 30 can be any appropriate structure for maintaining the container 12 in a fixed location on the wall 50, preferably with a rod connection.

Figure 3A:
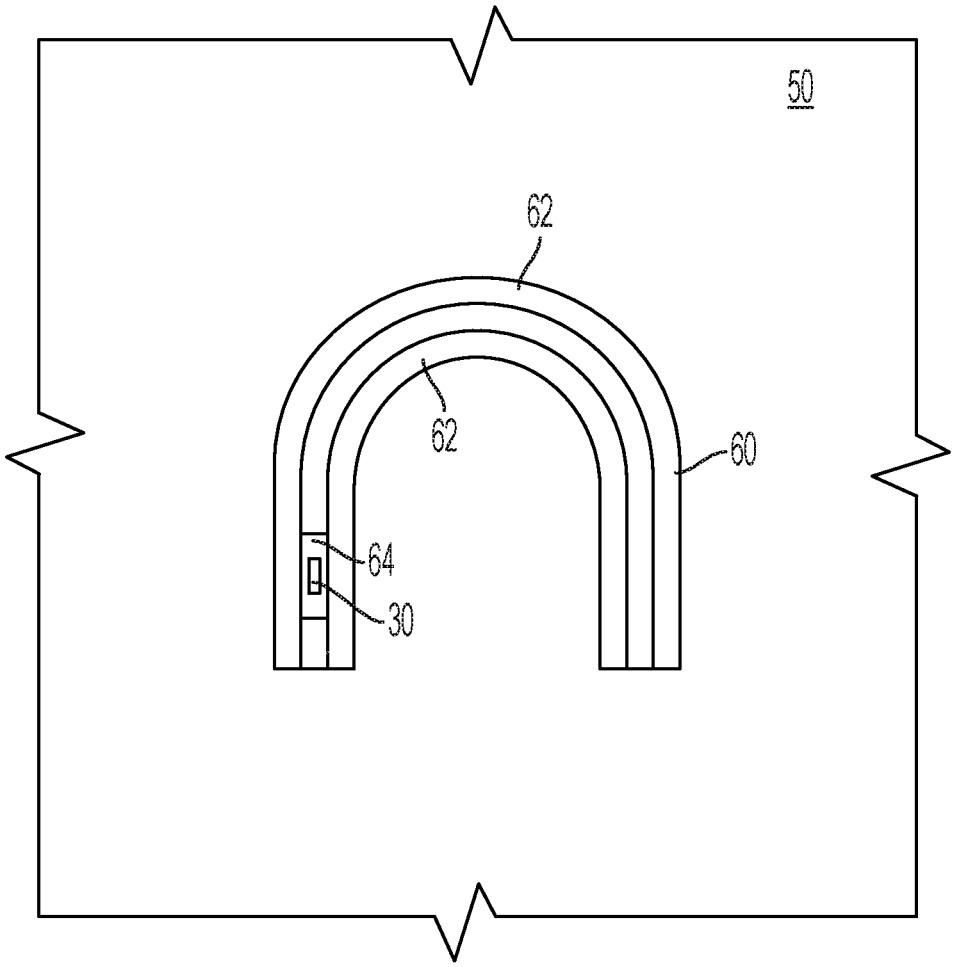
FIG. 3A shows an inverted U-shaped track of the toilet paper dispenser of the invention.

In one preferred embodiment, as seen in FIG. 3A, the support 30 imparts rotational movement to the container 12 through an inverted U-shaped track 60, with the inverted U-shaped track 60 present on either the container 12 or the attaching wall 50. Generally, the U-shaped track 60 includes a lip retaining member 62 to secure an insert 64 within the track 60.

In operation to replenish the toilet paper rolls 100A, 100B within the toilet paper dispenser 10 described herein, a maintenance person positions the container 12 in a vertical position with the first retaining member 20A directly above the second retaining member 20B. After removing the first retaining member 20A from the container 12 the maintenance person longitudinally slides the remaining paperboard core of the (used) first toilet paper roll 100A upwardly beyond the length of the first positioning insert 18A and out of the first space of the container 12. The maintenance person then longitudinally slides a replacement first toilet paper roll 100A downwardly over the length of the first positioning insert 18A with the first positioning insert 18A extending into the paperboard core of the first toilet paper roll 100A. This places the first toilet paper roll 100A into the first space of the container 12. Either during the placement of the first toilet paper roll 100A, or after placement, the maintenance person peels the initial sheets of the first toilet paper roll 100A from the replacement first toilet paper roll 100A and passes the initial sheet through the first opening 22A within the first space of the container 12. The end of the container 12 is secured by affixing the first retaining member 20A onto the container 12.

Alternatively, or additionally, the container 12 is then rotated approximately 180° or 90° about a longitudinal axis of the container 12 to facilitate replacement of the second toilet paper roll 100B in a similar manner. Replenishment includes positioning the container 12 in a vertical position with the second retaining member 20B directly above the first retaining member 20A, removing the second retaining member 20B from the container 12, longitudinally sliding the residual paperboard core of the used second toilet paper roll 100B upwardly beyond the length of the second positioning insert 18B and out of the second space 16B of the container 12, longitudinally sliding a replacement second toilet paper roll 100B downwardly over the length of the second positioning insert 18B and into the second space 16B of the container 12 and securing the second retaining member 20B onto the container 12. The container 12 is then repositioned with its longitudinal axis parallel to the ground.

In a particularly preferred embodiment, as seen in FIG. 7, the toilet paper dispenser 10 includes first and second openings 22A, 22B that extend into the void formed at either end of the cylinder 12. In this embodiment the outer edge of the two ends of the container 12 include an attaching mechanism 40 of a first set of screw ridges 40A on the outer surface of the surface of the container 12, and a second set of screw ridges 40B within the lip of a cap 42A, 42B, forming receiving screw ridges 40B within the cap 42A, 42B, for mating with the screw ridges 40A of the outer surface of the container 12. In this manner the opening 22A, 22B become enclosed by the caps 42A, 42B once the caps 42A, 42B are threaded onto the ends of the container 12.

In operation the retaining members 20A, 20B are unscrewed from the container 12, toilet paper rolls 100A, 100B are inserted into the container 12 with the first couple of sheets longitudinally passed into the openings 18A, 18B, and the retaining members 20A, 20B are screwed back onto the container 12.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A toilet paper dispenser, comprising:

a toilet roll container, the container defining a chamber sufficient to enclose a first toilet paper roll and a second toilet paper roll positioning the first and second paper rolls in an end to end orientation, the container further including one or more openings along a longitudinal axis of the container to disperse of sheets of toilet paper from the first and second toilet paper rolls when the first and second toilet paper rolls are present;

a first and second positioning insert, the first and second positioning inserts located on opposite sides of a central divider and centered thereon, the first and second inserts extending within the length of the container sufficient to stabilize the first and second toilet paper rolls within the first and second space when the first and second toilet paper rolls are present inside of the container;

a first and second retaining member for securing the first and second toilet paper rolls within the container, the first and second retaining member located on opposite ends of the container to secure the first and second toilet paper rolls within the container when the first and second toilet paper rolls are present inside of the container; and, a support for fixing the container to a wall structure, wherein the support includes a mechanism adapted to rotate the container around a center point of the longitudinal axis and lock the container in a rotated position.

2. The toilet paper dispenser of claim 1, wherein the container comprises a solid structure.

3. The toilet paper dispenser of claim 1, wherein the central divider within the container divides the container in a first and second space for accommodating the first and second toilet paper rolls, respectively, wherein the central divider separates the first and second toilet paper rolls when the first and second toilet paper rolls are present inside of the container.

4. The toilet paper dispenser of claim 1, wherein the first and second positioning inserts are affixed to the central divider.

5. The toilet paper dispenser of claim 1, wherein the first or second positioning inserts are affixed to the first and second retaining member, respectively.

6. The toilet paper dispenser of claim 1, wherein the first and second retaining members are attached to the central divider through-the first and second inserts.

7. The toilet paper dispenser of claim 1, wherein the first and second retaining members are attached to the container.

8. The toilet paper dispenser of claim 1, wherein the first and second retaining members are attached to the container using an attaching mechanism selected from the group consisting of threading, latch, snap and key.

9. The toilet paper dispenser of claim 1, wherein the support is fixed to the longitudinal center of the container.

10. The toilet paper dispenser of claim 1, wherein the support further includes a rotational movement that is locked at a 90° rotation.

11. The toilet paper dispenser of claim 10, wherein the support rotates approximately 180° about a longitudinal axis.

12. The toilet paper dispenser of claim 1, w herein the support comprises a rod connection.

13. The toilet paper dispenser of claim 1, wherein the support impart rotational movement to the container through an inverted U-shaped track.

14. The toilet paper dispenser of claim 1, wherein the inverted U-shaped track is present on the container.

15. The toilet paper dispenser of claim 1, wherein the inverted U-shaped track is present on an attaching wall.

16. A method for replenishing a toilet paper dispenser, comprising the steps of:

providing a toilet paper dispenser having a toilet roll container, the container defining a chamber sufficient to enclosed a first toilet paper roll and a second toilet paper roll positioning the first and second paper rolls in an end to end orientation, the container further including one or more openings along the longitudinal axis of the container to allow dispension of sheets of toilet paper from the first and second toilet paper rolls when the first and second toilet paper rolls are present, a central divider within the container dividing the container in a first and second space for accommodating the first and second toilet paper rolls, respectively, wherein the central divider separates the first and second toilet paper rolls when the first and second toilet paper rolls are present inside of the container, a first and second positioning insert, the first and second positioning inserts located on opposite sides of the central divider and centered thereon, the first and second inserts extending within the length of the container sufficient to stabilize the first and second toilet paper rolls within the first and second space when the first and second toilet paper rolls are present inside of the container, a first and second retaining member for securing the first and second toilet paper rolls within the container, the first and second retaining member located on opposite ends of the container to secure the first and second toilet paper rolls within the container when the first and second toilet paper rolls are present inside of the container and a support for-fixing the container to a wall structure, wherein the support includes a mechanism adapted to rotate the container around a center point of the longitudinal axis and lock the container in a rotated position;

positioning the container in a vertical position, wherein the first retaining member is directly above the second retaining member;

removing the first retaining member from the container;

longitudinally sliding the first toilet paper roll upwardly beyond the length of the first positioning insert and out of the first space of the container;

longitudinally sliding a replacement first toilet paper roll downwardly over the length of the first positioning insert and into the first space of the container; and, securing the first retaining member onto the container.

17. The method of claim 16 further comprising the step of peeling the initial sheets of toilet paper from the replacement first toilet paper roll and passing the initial sheet through the opening within the first space of the container.

18. The method of claim 16, further comprising the step of rotating the container approximately 90° about a longitudinal axis.

19. The method of claim 16, further comprising the steps of positioning the container in a vertical position, wherein the second retaining member is directly above the first retaining member;

removing the second retaining member from the container;

longitudinally sliding the second toilet paper roll upwardly beyond the length of the second positioning insert and out of the second space of the container;

longitudinally sliding a replacement second toilet paper roll downwardly over the length of the second positioning insert and into the second space of the container; and, securing the second retaining member onto the container.

20. A toilet paper dispenser, comprising:

a cylindrical toilet roll container, the container defining a chamber sufficient to enclose a first toilet paper roll and a second toilet paper roll positioning the first and second paper rolls in an end to end orientation, the container further including a first opening and second openings along the longitudinal axis of the container, the first and second opening extending from opposite ends, of the container into the opening at either end of the cylinder, the openings allowing dispersion of sheets of toilet paper from the first and second toilet paper rolls when the first and second toilet paper rolls are present;

a central divider within the container dividing the container in a first and second space for accommodating the first and second toilet paper rolls, respectively, wherein the central divider separates the first and second toilet paper rolls when the first and second toilet paper rolls are present inside of the container;

a first and second positioning insert, the first and second positioning inserts located on opposite sides of the central divider and centered thereon, the first and second inserts extending within the length of the container sufficient to stabilize the first and second toilet paper rolls within the first and second space when the first and second toilet paper rolls are present inside of the container;

a first and second retaining member for securing the first and second toilet paper rolls within the container, the first and second retaining member located on opposite ends of the container to secure the first and second toilet paper rolls within the container when the first and second toilet paper rolls are present inside of the container; and, a support for fixing the container a wall structure, wherein the outer edge of the two ends of the container include a first set of screw ridges on the outer surface of the surface of the container, and the first and second retaining members form a cap having receiving screw ridges therein for mating with the screw ridges of the outer surface of the surface of the container.

* * * * *